US008613604B2

(12) United States Patent
Nagano et al.

(10) Patent No.: US 8,613,604 B2
(45) Date of Patent: Dec. 24, 2013

(54) TURBOMOLECULAR PUMP

(75) Inventors: Yoshihiro Nagano, Kyoto (JP); Toshiki Yamaguchi, Nagaokakyo (JP); Takuto Onishi, Kyoto (JP); Masaki Ohfuji, Nagaokakyo (JP); Junichiro Kozaki, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 249 days.

(21) Appl. No.: 12/726,430

(22) Filed: Mar. 18, 2010

(65) Prior Publication Data

US 2010/0247336 A1 Sep. 30, 2010

(30) Foreign Application Priority Data

Mar. 18, 2009 (JP) ..... 2009-065807

(51) Int. Cl.
*F04B 39/06* (2006.01)

(52) U.S. Cl.
USPC ..... 417/423.4; 417/423.8; 417/423.12; 310/52; 310/54

(58) Field of Classification Search
USPC ..... 417/423.4, 423.12, 423.8, 373, 423.14; 310/54, 52, 89, 90, 68 R, 71
See application file for complete search history.

(56) References Cited

U.S. PATENT DOCUMENTS

| | | | | |
|---|---|---|---|---|
| 6,286,451 | B1 * | 9/2001 | Ishikawa et al. | 118/723 L |
| 6,398,524 | B1 * | 6/2002 | Taira et al. | 417/398 |
| 2001/0045262 | A1 * | 11/2001 | Gujer et al. | 156/345 |
| 2005/0051100 | A1 * | 3/2005 | Chiang et al. | 118/728 |

FOREIGN PATENT DOCUMENTS

| | | | |
|---|---|---|---|
| AU | 706634 | B2 | 7/1995 |
| JP | 10-238491 | A | 9/1998 |
| JP | 11-173293 | A | 6/1999 |
| JP | 11-173293 | A | 6/1999 |
| WO | WO-97/24532 | A1 | 7/1997 |

* cited by examiner

*Primary Examiner* — Peter J Bertheaud
*Assistant Examiner* — Dominick L Plakkoottam
(74) *Attorney, Agent, or Firm* — McDermott Will & Emery LLP

(57) ABSTRACT

The provision of the components requiring cooling on top of the cooling mechanism enables the cooling efficiency to be increased. Furthermore, a case of a control device is attached to the cooling mechanism whereon the components requiring cooling are disposed. The cooling mechanism fulfills the role of the contact surface of the case of the control device with the turbomolecular pump main unit, where the case does not have a case panel on the contact surface with the turbomolecular pump main unit. The cooling mechanism fulfills the role of one surface of the case for the control device, where the cooling mechanism is structured integrally with the control device. Additionally, the turbomolecular pump main unit, the cooling mechanism, and the control device are structured integrally by the turbomolecular pump main unit and the cooling mechanism being in contact.

3 Claims, 5 Drawing Sheets

TURBOMOLECULAR PUMP

CROSS REFERENCE TO RELATED APPLICATIONS

The present application claims priority under 35 U.S.C. §119 to Japanese Patent Application No. 2009-065807, filed Mar. 18, 2009, which is incorporated herein by reference.

FIELD OF TECHNOLOGY

The present invention relates to a cooling mechanism for a turbomolecular pump.

BACKGROUND OF THE INVENTION

In conventional turbomolecular pumps the turbomolecular pump main unit and the control device are structured separately, and thus the cooling mechanism for cooling the turbomolecular pump main unit and the cooling device for cooling those components of the control device that require cooling are provided separately, where the turbomolecular pump main unit and the control device are connected by a cable. This type of turbomolecular pump device has a problem in that two cooling mechanisms are required, and there may be errors in the adjustment of the cable length and in the connections.

Given this, there is a turbomolecular pump device wherein the turbomolecular pump main unit and the control device are integrated, and a cooling mechanism is provided therebetween (Japanese Unexamined Patent Application Publication H11-173293 ("JP '293")). Doing so enables the cooling mechanism to cool both the turbomolecular pump main unit and the components within the control device that require cooling, making it possible to eliminate a cooling mechanism, and also eliminate a long cable for connecting the two.

However, when the turbomolecular pump main unit and the control device are integrated as in the structure in JP '293, the control device and the cooling mechanism are structured separately and the two are brought into contact, and thus there is a problem in that it is necessary to have two panels, that is, the top surface panel of the case of the control device and the bottom surface panel of the cooling mechanism, at the surface of contact between the control device and the cooling mechanism, and a problem in that there are more components than are necessary.

Furthermore, the turbomolecular pump main unit requires periodic overhaul operations in order to remove foreign materials, and thus when the turbomolecular pump main unit and the control device are integrated, it is necessary to separate the turbomolecular pump main unit and the control device in order to perform the overhaul operations on the turbomolecular pump main unit, and thus there is a problem in that this increases the number of components and increases the labor involved in the overhaul operation. In particular, when the structure is such that the cooling mechanism is attached to the turbomolecular pump main unit and fitted into the control device, as in the invention set forth in JP '293, it is necessary to disassemble the turbomolecular pump main unit and the cooling mechanism after removing the turbomolecular pump main unit and the cooling mechanism from the control device, increasing the amount of work involved in the overhaul operations.

In addition, when fitting into the control device after installing the cooling mechanism into the turbomolecular pump main unit, as described above, it is necessary, in the assembly process of the turbomolecular pump device, to have a process for installing the cooling mechanism into the turbomolecular pump main unit, and thus it is not possible to assemble the turbomolecular pump device using the same processes as in the past. That is, when manufacturing both turbomolecular devices wherein the turbomolecular pump main unit and the control device are structured separately, and turbomolecular pump devices wherein the turbomolecular pump main unit and the control device are integrated and a cooling mechanism is provided therebetween, being able to use a common turbomolecular pump main unit would contribute to cost reductions and simplification of operations; however, when the cooling mechanism is attached to the turbomolecular pomp, it is not possible to use a common turbomolecular pump main unit.

Furthermore, because the cooling by the cooling mechanism is through the top surface panel of the case of the control device, rather than the components requiring cooling in the control device, such as transistors, and the like, contacting the bottom surface panel of the cooling device directly, there is a problem in that the cooling efficiency is low.

SUMMARY OF THE INVENTION

An embodiment for resolving the problem areas set forth above is a turbomolecular pump device wherein the turbomolecular pump main unit and the control device for controlling the turbomolecular pump main unit are integrated, wherein the contact surface of the turbomolecular pump main unit with the case of the control device is a cooling mechanism for cooling the turbomolecular pump main unit and the control device.

Another Embodiment for resolving the problems set forth above is a turbomolecular pump device as set forth in the above embodiment, wherein the components requiring cooling in the control device are disposed on the top surface on the control device side of the cooling mechanism.

A further embodiment for solving the problems set forth above is a turbomolecular pump provided with a cooling mechanism for cooling a turbomolecular pump main unit and a control device, between the turbomolecular pump main unit and the control device for controlling the turbomolecular pump main unit, wherein the control device into the cooling mechanism are fastened together.

The above enables a structure wherein the cooling mechanism and the control device are integrated in order for the cooling mechanism to fulfill the role as one panel of the control device case. Because of this, the turbomolecular pump device which, conventionally, has been structured from the three points of the turbomolecular pump main unit, the control device, and the cooling mechanism, when the turbomolecular pump main unit in the control device have been integrated, can be structured from the two points of a turbomolecular pump main unit and a control device that is equipped with the cooling mechanism. As a result, there are the effects of not only enabling a reduction in the number of components and a reduction in costs, but also of being able to simplify overhauls. Furthermore, because the turbomolecular pump main unit and the cooling mechanism and control device, which have been assembled separately, can be integrated, it is possible to assemble the turbomolecular pump main unit independently, enabling the turbomolecular pump main unit to be assembled in the same process as conventionally.

The embodiments also provide the components that require cooling in the control device on top of a cooling mechanism that fulfills the role of the case for the cooling device, in addition to the effects above, enabling an improvement in the cooling efficiency for the components requiring cooling, which have conventionally been cooled with the cooling device case therebetween.

The embodiment enables the integration of the turbomolecular pump main unit and a cooling mechanism and control device that have been assembled separately, enabling the assembly of the turbomolecular pump main unit individually.

DETAILED DESCRIPTION OF THE INVENTION

Figure 4:
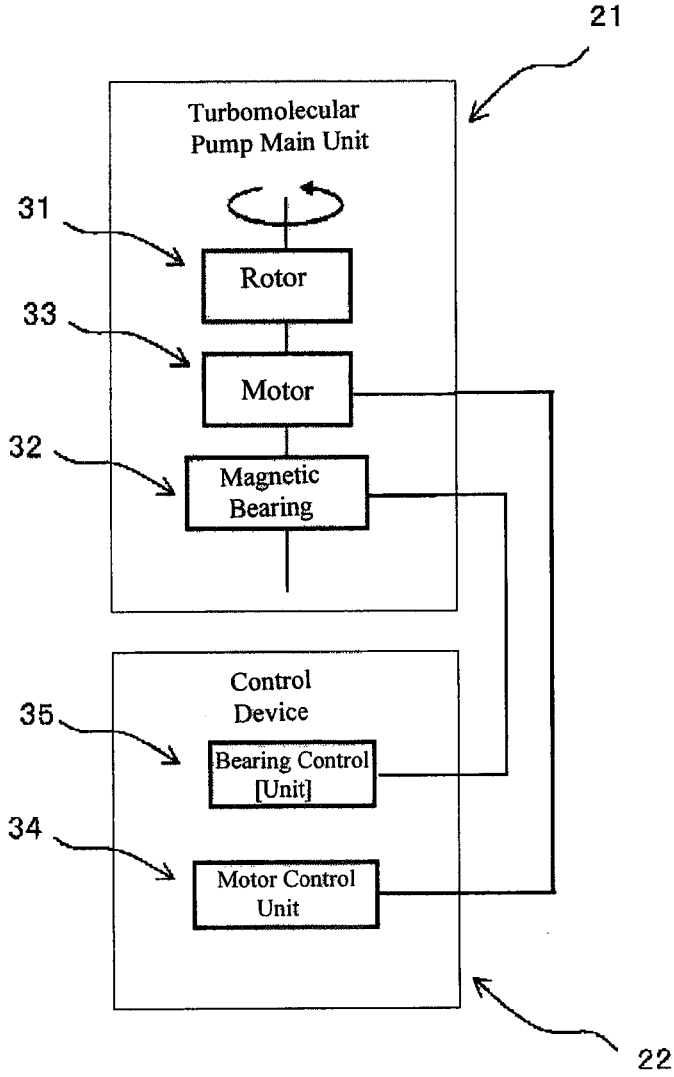
FIG. 4 is a block diagram illustrating a schematic structure of a turbomolecular pump device.

A form of embodiment according to the present invention will be explained in detail below in reference to the drawings. FIG. 4 is a block diagram illustrating the schematic structure of a form of embodiment of a turbomolecular pump device according to the present invention. The turbomolecular pump device comprises a turbomolecular pump main unit 21 and a control device 22. A rotor 31 comprising a rotary vane is provided in the turbomolecular pump main unit 21. A rotor 31 is non-contact supported by a magnetic bearing 32, and driven rotationally by a motor 33. On the other hand, the control device 22 is provided with a motor controlling unit 34 for driving the motor 33, and a bearing controlling unit 35 for controlling a magnetic excitation current provided to the magnetic bearing 32.

Figure 5:
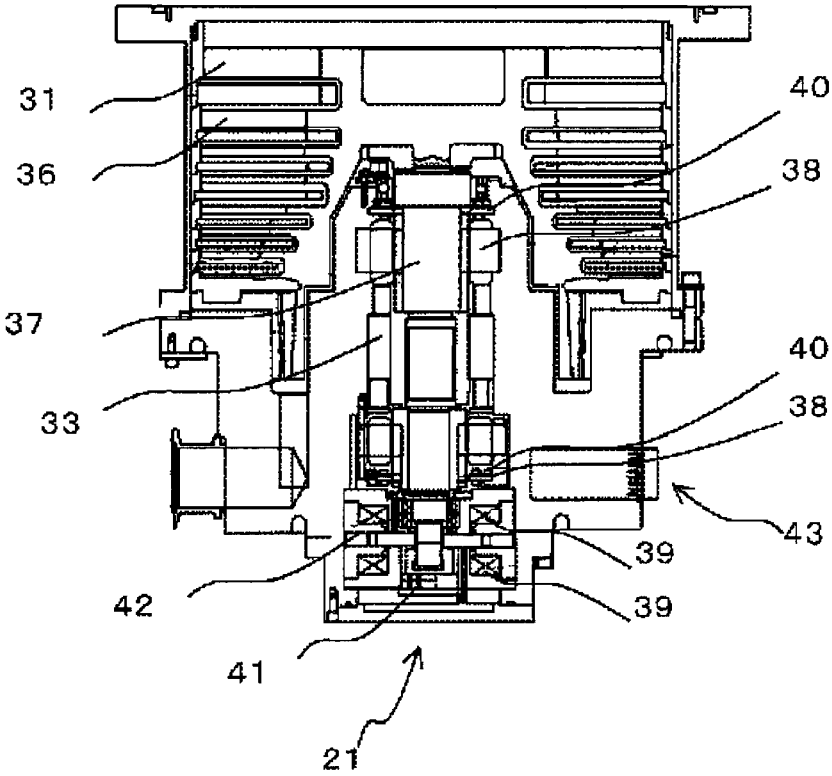
FIG. 5 is a schematic diagram of the turbomolecular pump main unit.

FIG. 5 is a diagram for explaining a summary of the turbomolecular pump main unit 21 in the present invention. The turbomolecular pump main unit 21 is provided with a rotor 31 that is motor-driven within a casing. The rotor 31 is provided with a rotary vane and is driven with a high rotational speed relative to a stator 36 that is provided on the casing side, specifically, driven to a high rotational speed of several tens of thousands of revolutions per minute, to draw in and compress air molecules from an intake opening and exhaust them through an exhaust opening.

The rotor 31 is driven rotationally by a motor 33 through a rotary shaft 37 that is affixed coaxially to the rotor 31. The motor 33 is structured from a coil (not shown) provided on the casing side, and magnetic poles provided on the rotary shaft 37. Additionally, the rotary shaft 37 is non-contact supported, through magnetic levitation, by a radial bearing electromagnet 38, a thrust bearing electromagnet 39, a radial position sensor 40, and a thrust position sensor 41.

The radial electromagnetic bearing (a bearing in the X-Y axial directions) has radial bearing electromagnets 38 disposed in opposition with the rotary shaft 37 held therebetween, and a radial position sensor 40 for sensing dislocation of the rotary shaft 37 in the radial direction, where the electric current that is applied to the radial bearing electromagnets 38 is adjusted based on the dislocation detected by the radial position sensor 40, to control the position of the rotary shaft 37 in the radial direction to a predetermined position. Note that in FIG. 2 there are two sets provided, on the top and on the bottom, with the motor 33 therebetween.

Additionally, the thrust bearing (Z-axial direction bearing) has a rotor disk 42 that is provided coaxially with the rotary shaft 37, and thrust bearing electromagnets 39 disposed above and below, with the rotor disk 42 held therebetween, along with a thrust position sensor 41 for sensing dislocation of the rotary shaft 37 in the thrust direction, where the current that is supplied to the thrust bearing electromagnet 39 is adjusted based on the dislocation sensed by the thrust position sensor 41 to control the position of the rotary shaft 37 in the thrust direction to a specific position.

Figure 6:
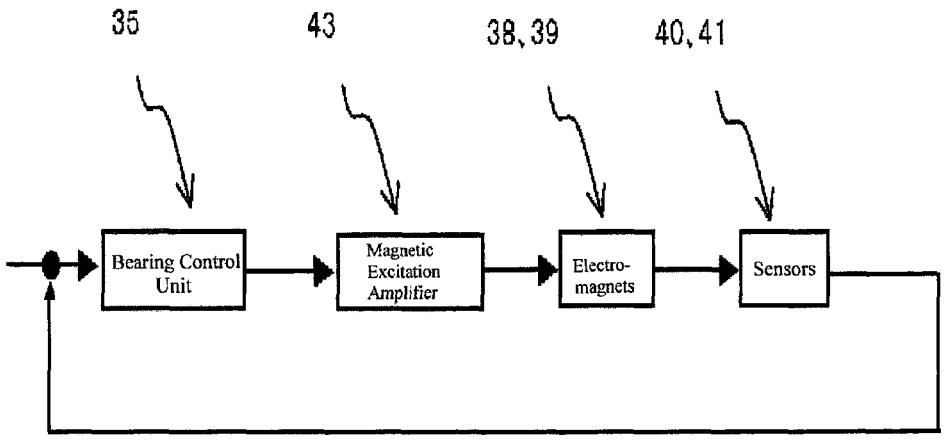
FIG. 6 is a schematic diagram of a feedback loop used in controlling a magnetic bearing.

FIG. 6 is a schematic diagram of a feedback loop used in controlling the magnetic bearings. A PID circuit, a phase compensating circuit, and a filter for stabilization are provided in this control circuit, enabling desirable frequency response to be obtained. The electromagnetic current that is controlled by the bearing control unit 7 is inputted into the magnetic excitation amplifier 43 and outputted to the radial bearing electromagnets 38 and the thrust bearing electromagnets 39. The effects thereof are detected by the radial position sensor 40 and the thrust position sensor 41 to perform feedback control.

Figure 1:
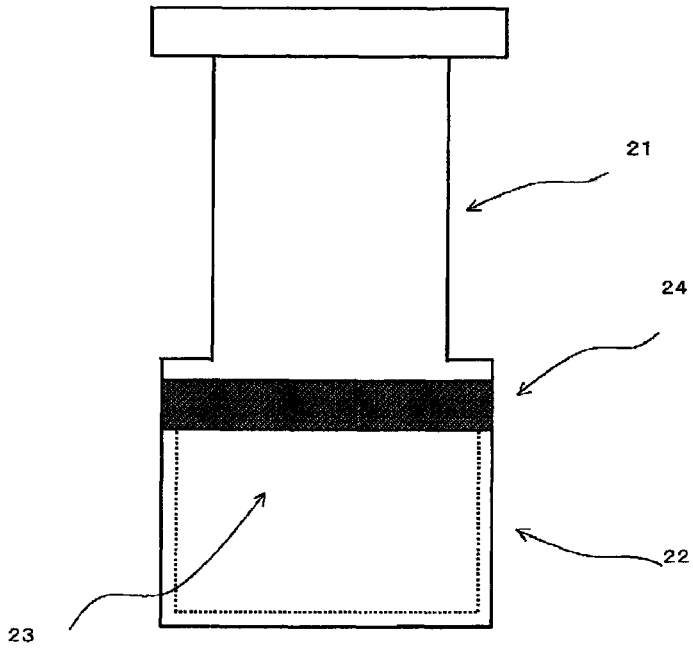
FIG. 1 is a schematic diagram of a turbomolecular pump device as set forth in the present invention.

FIG. 1 is a schematic structural diagram of a turbomolecular pump device according to the present invention. In the turbomolecular pump device that is structured with the turbomolecular pump main unit 21 and the control device 22 as a single unit, a cooling mechanism 24 is provided therebetween. The cooling mechanism 24 cools both the turbomolecular pump main unit 21 and the components requiring cooling within the control device 22.

Figure 2:
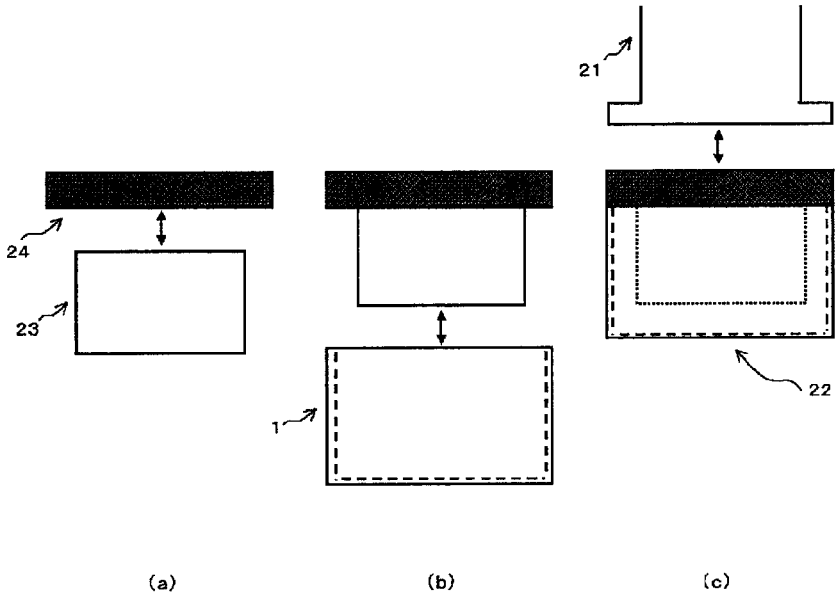
FIG. 2 is a schematic diagram illustrating the structure of the turbomolecular pump device as set forth in the present invention.

FIG. 2 is a structural diagram illustrating a specific configuration of a turbomolecular pump device according to the present invention. As in FIG. 2(*a*), the components 23 that require cooling within the control device are disposed on the top surface of the cooling mechanism 24. Here the components 23 that require cooling can be considered to be those components such as transistors, transformer coils, electrolytic capacitors, and the like, that produce heat within the circuits. During manufacturing, a circuit board, or the like, upon which are mounted these components 23 that require cooling may be assembled in advance and installed on the cooling mechanism 24, or may be assembled onto the cooling mechanism 24. Providing the components 23 that require cooling onto the cooling mechanism 24 in this way enables the cooling efficiency to be increased when compared to the case wherein the cooling mechanism is provided on the outside surface of the case of the control device, as has been done conventionally.

In FIG. 2(*b*), a control device case 1 is attached to the cooling mechanism 24 on which the components 23 that require cooling are disposed. The cooling mechanism 24 fulfills the role of the contact surface of the control device case 1 with the turbomolecular pump main unit 21, and thus the case 1 does not have a case panel that is a contact surface with the turbomolecular pump main unit 21. In this way, the cooling mechanism 24 fulfills the role of being one surface of the case 1 of the control device, so the cooling mechanism 24 is structured integrally with the control device 22.

FIG. 2(*c*) illustrates a structure wherein the turbomolecular pump main unit 21, the cooling mechanism 24, and the control device 22 are integrated into a single unit by the turbomolecular pump main unit 21 contacting the cooling mechanism 24. In this way, the cooling mechanism 24 is able to cool both the turbomolecular pump main unit 21 and the control device 22. Note that because the temperature in the vicinity of the exhaust 43 wherein a screw groove pump is provided becomes hot in the turbomolecular pump main unit 21, preferably the cooling mechanism 24 is provided in the vicinity of the exhaust opening 43.

Figure 3:
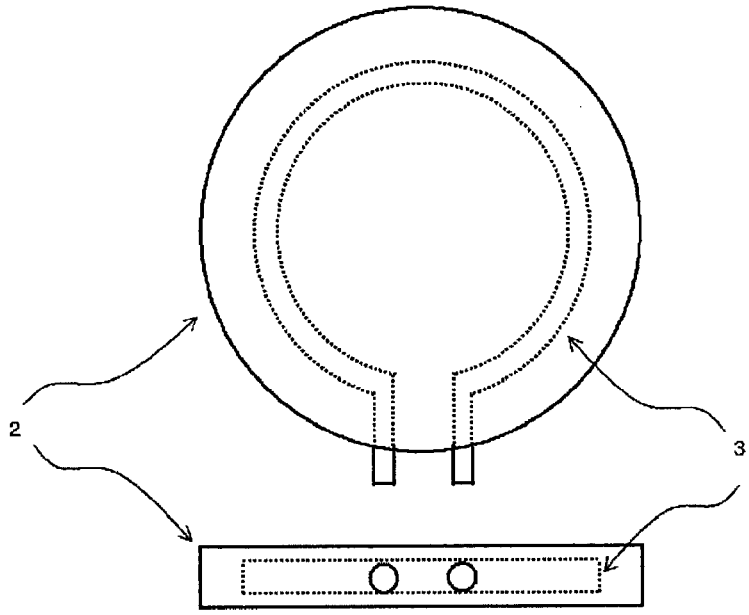
FIG. 3 is a schematic diagram of the cooling structure used in the turbomolecular pump device as set forth in the present invention.

FIG. 3 is a schematic structural diagram of a cooling mechanism used in the turbomolecular pump device according to the present invention. The cooling mechanism may be structured from, for example, a water-cooled plate, such as illustrated in the figure. The water-cooled plate has water cooling ducts embedded in a metal plate 2 through casting or pressing. The flow of cooling water within the water cooling ducts 3 cools the metal plate 2, to cool both the turbomolecular pump main unit 21 and the components 23 requiring cooling within the control device 22. Note that the cooling mechanism 24 may be an oil-cooled plate, or the like, rather than a water-cooled plate.

Figure 7:
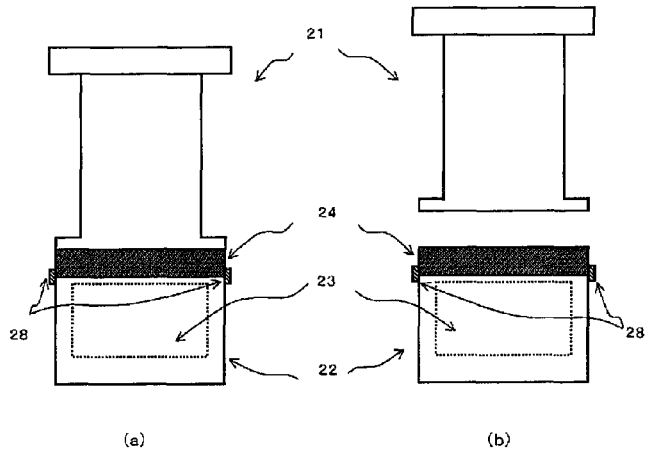
FIG. 7 is a schematic diagram of a modified example of embodiment of a turbomolecular pump device according to the present invention.

FIG. 7 is a schematic diagram of an alternate example of embodiment of a turbomolecular pump device according to the present invention. In the present invention, the control device 22 and the cooling mechanism 24 are connected by a connecting structure 28 and the cooling mechanism 24 and the connecting structure 28, which are joined together, are attached to the turbomolecular pump main unit 21. The connecting structure 28 has no particular limitations thereon insofar as it can connect the control device 22 and the cooling mechanism 24, and may be, for example, a connector that uses bolts, means such as the use of welding, or the like. Because the turbomolecular pump main unit 21 can be integrated with the cooling mechanism 24 and the control device 22 that are assembled separately, the turbomolecular pump main unit can be assembled by itself. Doing so enables the use of common turbomolecular pump main units when manufacturing both turbomolecular pump devices wherein the turbomolecular pump main unit and the control device are structured separately and turbomolecular pump devices wherein the turbomolecular pump main unit and the control device are integrated with the cooling mechanism disposed therebetween, thus enabling a contribution to cost reductions and simplified operations.

The invention claimed is:

1. A turbomolecular pump device comprising:

a turbomolecular pump main unit;

a control device for controlling the turbomolecular pump main unit, the control device being integrated with the turbomolecular pump main unit; and a cooling mechanism for cooling the turbomolecular pump main unit and the control device;

a case for the control device, the case having an integral top plate which has a first surface contacting the turbomolecular pump main unit and a second surface contacting the control device, wherein the top plate is the cooling mechanism, and the cooling mechanism is a water-cooled plate having a water cooling duct embedded in a metal plate or an oil-cooled plate having an oil cooling duct embedded in a metal plate.

2. A turbomolecular pump device as set forth in claim 1, wherein components requiring cooling in the control device are disposed on a top surface on the control device side of the cooling mechanism.

3. A turbomolecular pump device as set forth in claim 1, wherein the control device and the cooling mechanism are fastened together by a fastening member before the control device and the turbomolecular pump main unit are integrated.

* * * * *